US006793096B1

(12) United States Patent
Seok

(10) Patent No.: US 6,793,096 B1
(45) Date of Patent: Sep. 21, 2004

(54) FOOD ITEM RECEIVING CONTAINER

(75) Inventor: Chong-Chul Seok, Incheon (KR)

(73) Assignee: Hana Cobi Co., Ltd., Incheon (KR)

( * ) Notice: Subject to any disclaimer, the term of this patent is extended or adjusted under 35 U.S.C. 154(b) by 0 days.

(21) Appl. No.: 10/679,321

(22) Filed: Oct. 7, 2003

(30) Foreign Application Priority Data

Apr. 8, 2003 (KR) ..... 20-2003-0010553
May 12, 2003 (KR) ..... 20-2003-0014507

(51) Int. Cl.[7] ..... B65D 41/18
(52) U.S. Cl. ..... 220/788; 220/326
(58) Field of Search ..... 206/1.5; 220/315, 220/324, 326, 784, 788, 794; 215/216, 237

(56) References Cited

U.S. PATENT DOCUMENTS 1,961,181 A * 6/1934 Von Der Heydt ..... 220/326
5,311,990 A * 5/1994 Kalinski ..... 220/326
5,582,314 A * 12/1996 Quinn et al. ..... 220/326
5,641,065 A * 6/1997 Owens et al. ..... 220/324
5,887,745 A * 3/1999 Wood ..... 220/326
6,364,152 B1 * 4/2002 Poslinski et al. ..... 220/788
6,415,947 B1 * 7/2002 Kim ..... 220/788

* cited by examiner

*Primary Examiner*—Luan K. Bui
(74) *Attorney, Agent, or Firm*—Birch, Stewart, Kolasch & Birch, LLP

(57) ABSTRACT

A food item receiving container. A case defines a receiving space. A lid functions to close the case. Locking wings are integrally formed at edges of the lid, so that they can be pivoted upward and downward. Flange portions are formed on upper end outer surfaces of sidewalls of the case, so that the locking wings are engaged with the flange portions to be maintained in a locked state. An engaging groove is defined on a lower surface of each flange portion. Each locking wing has an elastic engaging part which is formed to be flexed and cover the lower surface of the flange portion when the corresponding locking wing is pivoted downward, and engaging protuberances which are horizontally formed on an upper surface of the elastic engaging part to be engaged with the engaging groove of the flange portion while elastically deforming the elastic engaging part.

3 Claims, 8 Drawing Sheets

PRIOR ART

FOOD ITEM RECEIVING CONTAINER

BACKGROUND OF THE INVENTION

1. Field of the Invention

The present invention relates, in general, to a food item receiving container and, more particularly, to a food item receiving container which is constructed to prevent odor and/or water from leaking to thereby keep a food item in an airtight manner.

2. Description of the Prior Art

Generally, when placing a food item in a refrigerator, etc., peculiar odor of the food item and/or water is likely to leak. In order to avoid this situation, the food item is normally received in an airtight receiving container.

Referring to FIG. 1, a conventional airtight receiving container includes a case 1 opened at an upper end thereof, a lid 2 for opening and closing the case 1, and locking wings 3 for locking the lid 2 to the opened upper end of the case 1.

The case 1 has a rectangular box-shaped configuration which defines a receiving space therein. Adjacent to upper ends of four side walls 1*a* and 1*b* of the case 1, locking projections 4 are formed. In this regard, two locking projections 4 are projectedly formed on an outer surface of each side wall 1*a* and 1*b* of the case 1.

A sealing groove (not shown) is continuously defined adjacent to four edges on a lower surface of the lid 2 so that the opened upper end of the case 1 can be inserted into the sealing groove.

The locking wings 3 are formed integrally with four respective sides of the lid 2 so that they can be pivoted upward and downward (in directions shown by the arrows) Two locking slots 5 are defined in each locking wing 3 to be operatively associated with the two locking projections 4.

Therefore, after a food item is received in the receiving space of the case 1 by a user, the lid 2 is closed, and the locking wings 3 formed integrally with the lid 2 are pivoted downward. In doing so, the locking projections 4 formed on the side walls 1*a* and 1*b* of the case 1 are engaged into the locking slots 5, respectively, whereby the lid 2 is firmly locked to the case 1.

If the four locking wings 3 are pivoted upward, the locking projections 4 are disengaged from the locking slots 5. In this way, the lid 2 is opened.

However, the conventional airtight receiving container constructed as mentioned above suffers from defects in that, since the locking projections 4 of a substantial size are projectedly formed on the side walls 1*a* and 1*b* of the case 1, an aesthetic appearance of the airtight receiving container is deteriorated. Also, the possibility of the locking projections 4 to hinder an operation for washing the case 1 is increased. That is to say, when washing the case 1 using a scrubber, etc., the locking projections 4 projectedly formed on the side walls 1*a* and 1*b* of the case 1 may hinder the washing operation.

Further, because the locking slots 5 are defined in the locking wings 3, the likelihood of a foreign substance to be captured in the locking slots 5 is increased, whereby sanitary issues are raised.

SUMMARY OF THE INVENTION

Accordingly, the present invention has been made keeping in mind the above problems occurring in the prior art, and an object of the present invention is to provide a food item receiving container in which locking wings and their locking pattern are modified in such a way as to render an aesthetic appearance of the container and increase user convenience.

Another object of the present invention is to provide a food item receiving container in which locked states of the locking wings are maintained in a reliable manner.

In order to achieve the above object, according to one aspect of the present invention, there is provided a food item receiving container, comprising: a case opened at an upper end thereof to define a receiving space therein; a lid for closing the opened upper end of the case; a plurality of locking wings integrally formed at edges of the lid, respectively, so that they can be pivoted upward and downward; and flange portions projectedly formed in the shape of a band on upper end outer surfaces of side walls of the case, respectively, so that the locking wings can be engaged with the flange portions to be maintained in a locked state; wherein at least one engaging groove is defined on a lower surface and at a middle portion, facing a corresponding locking wing, of each flange portion, and wherein each locking wing has an elastic engaging part which is formed to be flexed and thereby cover the lower surface of the flange portion when the corresponding locking wing is pivoted downward, and engaging protuberances which are horizontally formed on an upper surface of the elastic engaging part to be engaged with the engaging groove of the flange portion while elastically deforming the elastic engaging part.

According to another aspect of the present invention, two elongate engaging grooves are parallel defined on the lower surface of the flange portion; and two elongate engaging protuberances are formed on the upper surface of the elastic engaging part of the locking wing to be engaged into the two elongate engaging grooves, respectively.

According to still another aspect of the present invention, the engaging groove of the flange portion is formed with a first inclined surface which is inclined upward from an outside toward an inside of the flange portion; and the upper surface of the elastic engaging part of the locking wing comprises a second inclined surface which is inclined in an opposite direction to the first inclined surface of the engaging groove so that the second inclined surface is engaged with the first inclined surface while the locking wing is in the locked state.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
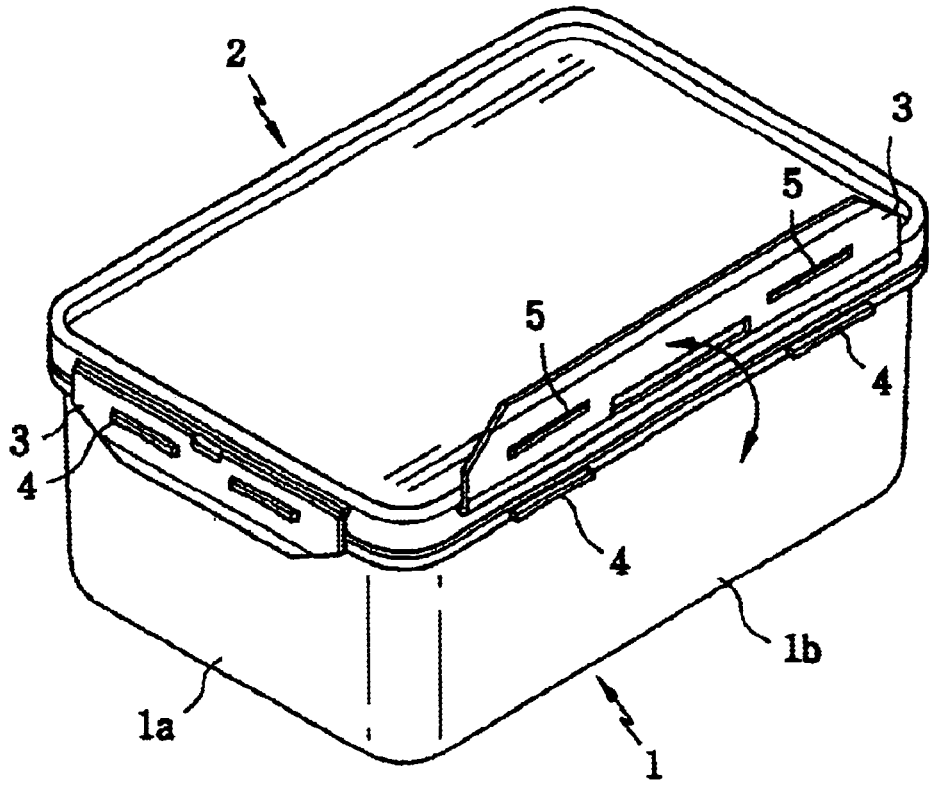
FIG. 1 is a perspective view schematically illustrating a conventional airtight container for receiving a food item.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
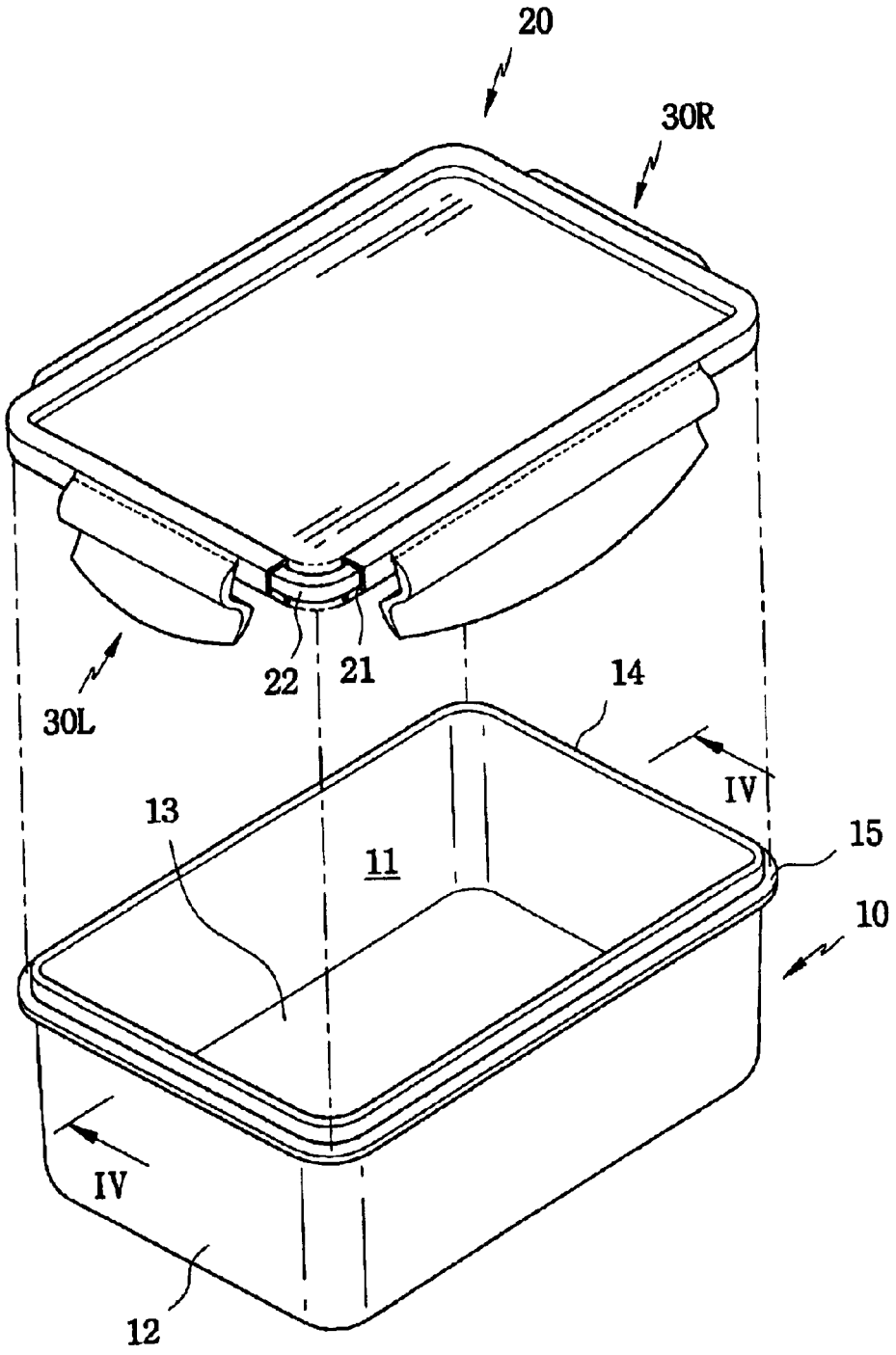
FIG. 2 is a partially broken-away exploded perspective view illustrating a food item receiving container in accordance with a first embodiment of the present invention.

Referring to FIG. 2, a food item receiving container in accordance with a first embodiment of the present invention includes a rectangular case 10 which is formed by injection-molding of plastic and defines a receiving space 11 therein, a rectangular plate-shaped lid 20 which is coupled to the rectangular case 10 to close an opened upper end of the rectangular case 10, and locking wings 30L and 30R for locking the lid 20 to the case 10 in a state wherein the lid 20 closes the opened upper end of the case 10.

Concretely speaking, the rectangular case 10 has a configuration of a rectangular box which has four side walls 12 and one bottom wall 13. The receiving space 11 which is opened at an upper end thereof is defined in the rectangular case 10. Sealing projections 14 are formed on upper ends of the four side walls 12, that is, along the opened upper end of the case 10, so that the rectangular lid 20 can be coupled to the sealing projections 14.

At the upper ends of the four side walls 12 and adjoining the sealing projections 14, flange portions 15 having the shape of a band are projectedly formed on outer surfaces of the side walls 12, so that the locking wings 30L and 30R can be engaged with the flange portions 15 to be maintained in a locked state.

Figure 3:
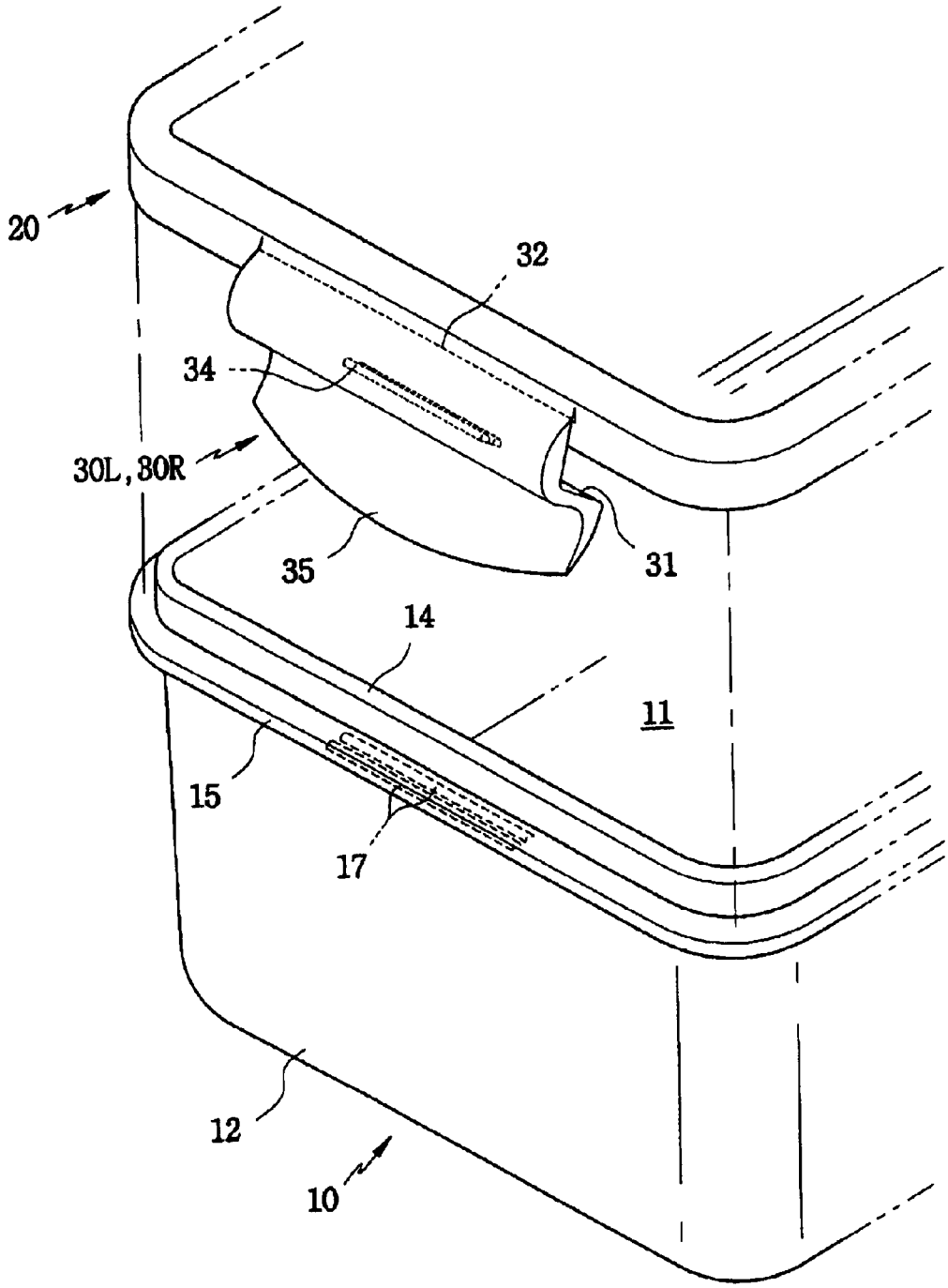
FIG. 3 is a partial enlarged perspective view illustrating the food item receiving container according to the first embodiment of the present invention.
Figure 4:
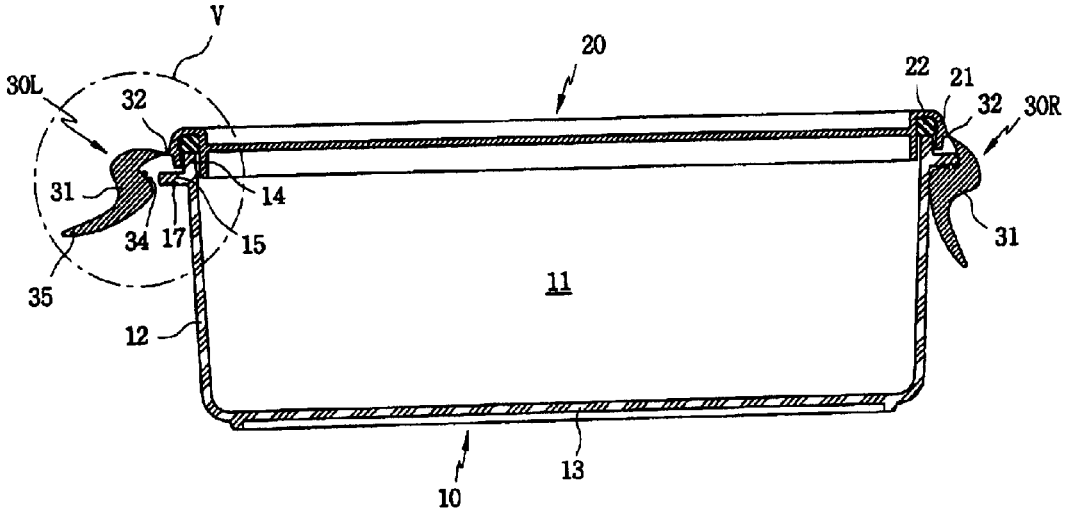
FIG. 4 is a cross-sectional view taken along the line IV—IV of FIG. 2.
Figure 5:
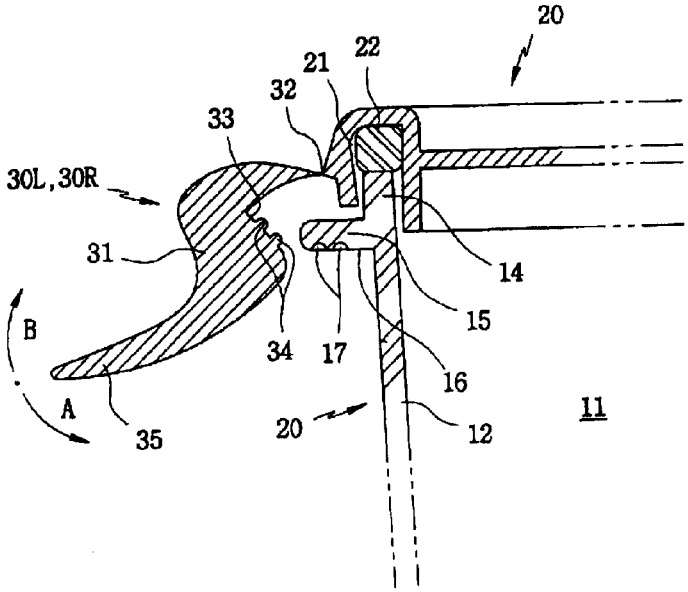
FIG. 5 is a partial enlarged cross-sectional view for the 'V' part of FIG. 4, illustrating a structure of a locking wing.

To this end, as can be readily seen from FIGS. 3 through 5, engaging grooves 17 of a predetermined length are defined on lower surfaces 16 and at middle portions, facing the respective locking wings 30L and 30R, of the flange portions 15. In this preferred embodiment of the present invention, two elongate engaging grooves 17 are parallel defined on the lower surface 16 of each flange portion 15.

Further, referring to FIGS. 3 and 4, the rectangular lid 20 functions to open and close the opened upper end of the rectangular case 10, and is also formed by injection-molding of plastic. Sealing grooves 21 are defined adjacent to edges of the rectangular lid 20. A sealing packing 22 is accommodated in the sealing grooves 21. Accordingly, if the sealing projections 14 are inserted into the sealing grooves 21, as the sealing packing 22 is squeezed, the rectangular lid 20 is firmly coupled to the opened upper end of the rectangular case 10.

In the meanwhile, referring to FIGS. 3 through 5, the locking wings 30L and 30R are symmetrically formed at front, rear, left and right sides of the rectangular lid 20 so that they can be grasped by a user's hand when opening and closing the foot item receiving container. A locking structure of the rectangular lid 20 will be described below in detail (since the locking wings 30L and 30R formed at four sides of the rectangular lid 20 have the same locking structure, the locking structure will be described with reference to the locking wings formed at left and right sides of the rectangular lid 20).

First, the locking wings 30L and 30R are integrally formed at the middle portions of the four sides of the rectangular lid 20 so that the locking wings 30L and 30R can be locked to the flange portions 15 of the rectangular case 10. In other words, the locking wings 30L and 30R are formed integrally with the four sides of the rectangular lid 20 using the same material, so that they can be pivoted upward and downward about boundary regions 32 between the rectangular lid 20 and the locking wings 30L and 30R (in the directions shown by the arrows 'A' and 'B' in FIG. 5). Namely, the boundary regions 32 serve as hinges. The reason for this is in that the rectangular lid 20 and the locking wings 30 are integrally injection-molded using synthetic resin having a predetermined elasticity.

Each locking wing 30L and 30R has an elastic engaging part 31 which covers the lower surface 16 of the flange portion 15 when locking the lid 20 to the case 10, engaging protuberances 34 which are engaged in the engaging grooves 17 of the flange portion 15 while elastically deforming the elastic engaging part 31, and an extended part 35 which is curved to allow the locking wing 30L and 30R to be pressed and raised by the user's hand.

While each locking wing 30L and 30R is pivoted downward about the boundary region 32 (in the direction shown by the arrow 'A' in FIG. 5) to lock the lid 20 to the case 10, the elastic engaging part 31 is flexed to cover the lower surface 16 of the flange portion 15. At a completely pivoted position, an upper surface 33 of the elastic engaging part 31 confronts the lower surface 16 of the flange portion 15.

The engaging protuberances 34 are formed on the upper surface 33 of the elastic engaging part 31to project in a horizontal direction and elastically engaged into the engaging grooves 17. Two elongate engaging protuberances 34 are formed on the upper surface 33 of the elastic engaging part 31 of each locking wing 30L and 30R to be properly engaged into the two elongate engaging grooves 17, respectively.

Hereafter, locking operations using the locking wings 30L and 30R of the food item receiving container according to the present invention and effects thereof will be described.

First, after a food item to be stored is received in the receiving space 11 of the rectangular case 10, the rectangular lid 20 is placed on the opened upper end of the rectangular case 10. Namely, the rectangular lid 20 is placed on the rectangular case 10 so that the sealing projections 14 of the rectangular case 10 are inserted into the sealing grooves 21 of the rectangular lid 20, in which the silicon packing 22 is accommodated. At this time, since the sealing projections 14 are inserted into the sealing grooves 21, the initially placed rectangular lid 20 is prevented from being moved.

Figure 6:
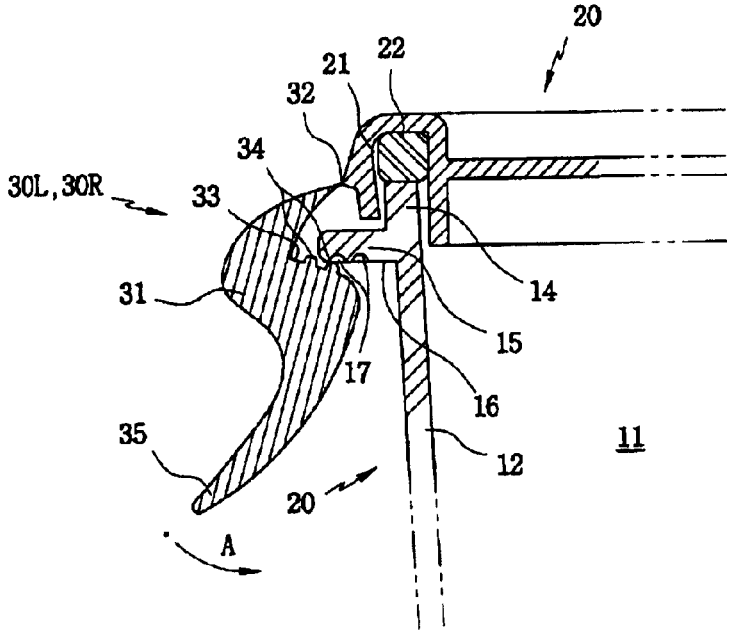
FIGS. 6 and 7 are partial cross-sectional views sequentially illustrating a locking procedure of the locking wing.
Figure 7:
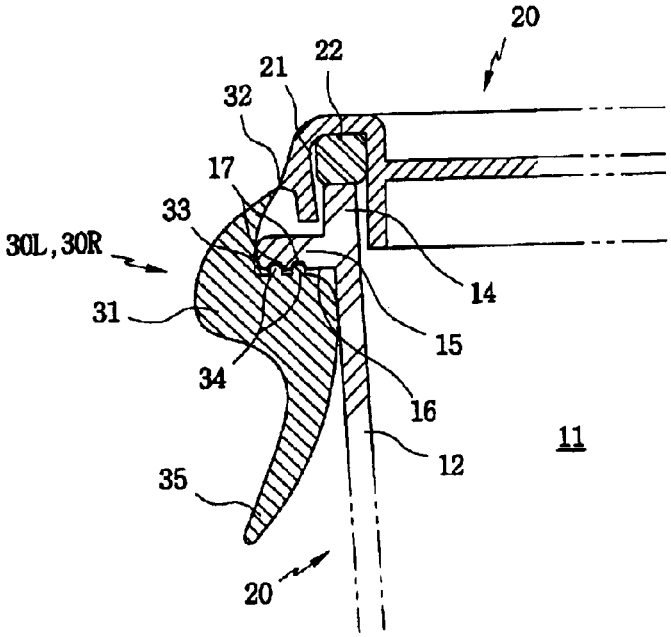

In this state, as shown in FIGS. 6 and 7, if the extended part 35 of each locking wing 30L and 30R is pressed downward, the locking wing 30L and 30R is pivoted about the boundary region 32 of the rectangular lid 20 in the direction shown by the arrow 'A'. Consequently, as the elastic engaging part 31 is elastically deformed, the elastic engaging part 31 covers the lower surface 16 of the flange portion 15, and the two elongate engaging protuberances 34 are respectively engaged into the two elongate engaging grooves 17 of the flange portion 15. That is to say, due to this fact that the two elongate engaging protuberances 34 are elastically engaged into the two elongate engaging grooves 17, the locking wings 30L and 30R are held in a locked state, and the rectangular lid 20 is closed in an airtight manner.

In this way, the rectangular lid 20 is locked in a one-touch manner along the flange portion 15 of the rectangular case 10. In this state, the rectangular lid 20 remains locked to the rectangular case 10 until an intended opening force is applied.

Meanwhile, if the extended part 35 of each locking wing 30L and 30R is grasped and raised, as the elastic engaging part 31 of the locking wing 30L and 30R is elastically deformed, the two elongate engaging protuberances 34 are disengaged from the two elongate engaging grooves 17. Therefore, as the locked state of the locking wings 30L and 30R is released, it is possible to easily remove the rectangular lid 20 to open the rectangular case 10.

With the rectangular lid 20 removed from the rectangular case 10, since the locking structures of the rectangular case 10, for locking the locking wings 30L and 30R, are not exposed to the outside, an aesthetic outer appearance of the receiving container is not deteriorated, and it is possible to easily wash the rectangular case 10.

Herein below, a construction of a food item receiving container in accordance with a second embodiment of the present invention will be described in detail. Because the receiving container of this second embodiment is constructed in the same manner as the receiving container of the first embodiment except a locking structure of locking wings, detailed description for the same component elements will be omitted herein.

At upper ends of the four side walls 112 and adjoining sealing projections 114, flange portions 115 having the shape of a band are projectedly formed on outer surfaces of the side walls 112 of a rectangular case 110, so that locking wings 130 of a rectangular lid 120 can be engaged with the flange portions 115 to be maintained in a locked state.

Figure 8:
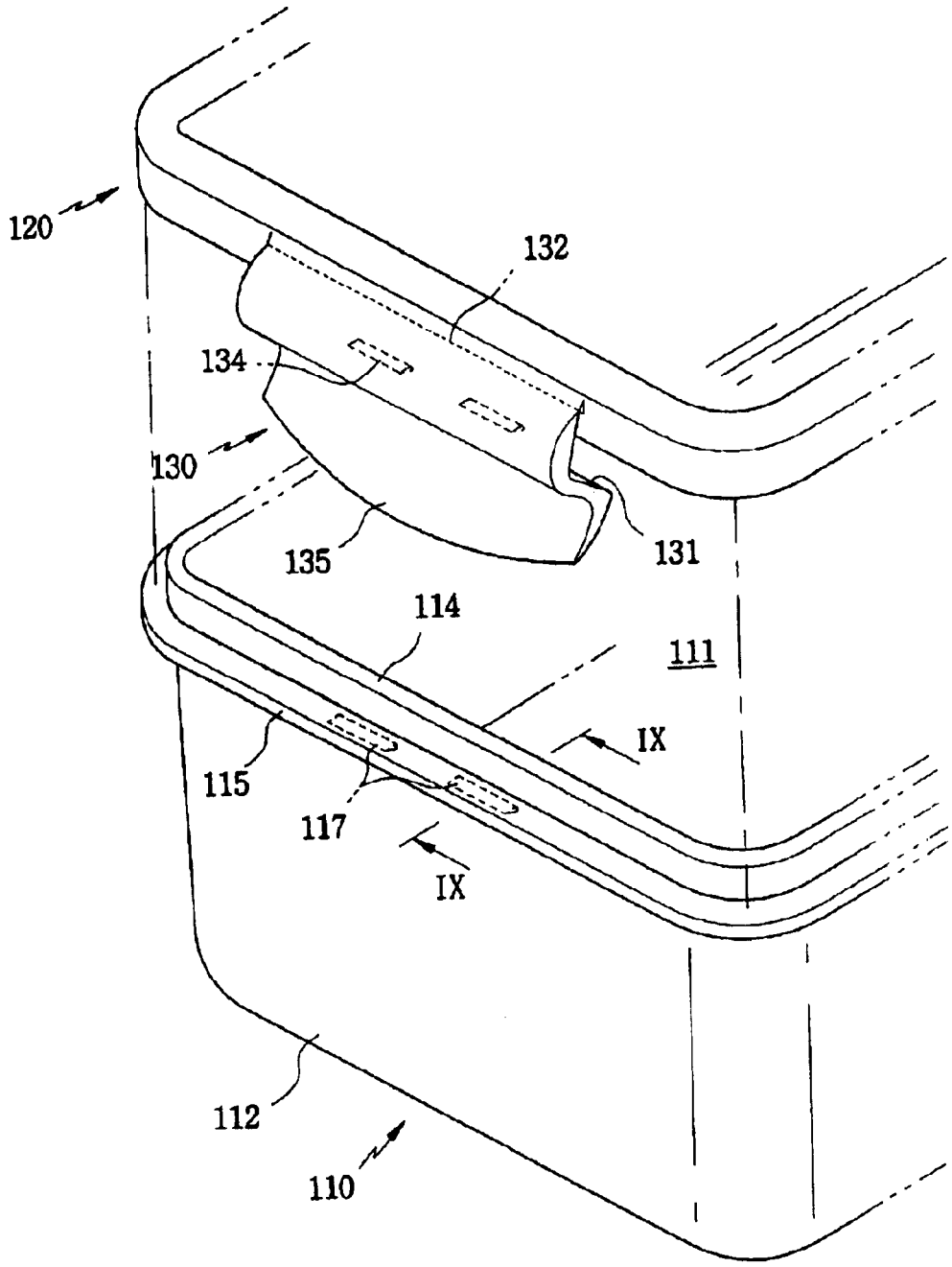
FIG. 8 is a partial enlarged perspective view illustrating a food item receiving container in accordance with a second embodiment of the present invention.
Figure 9:
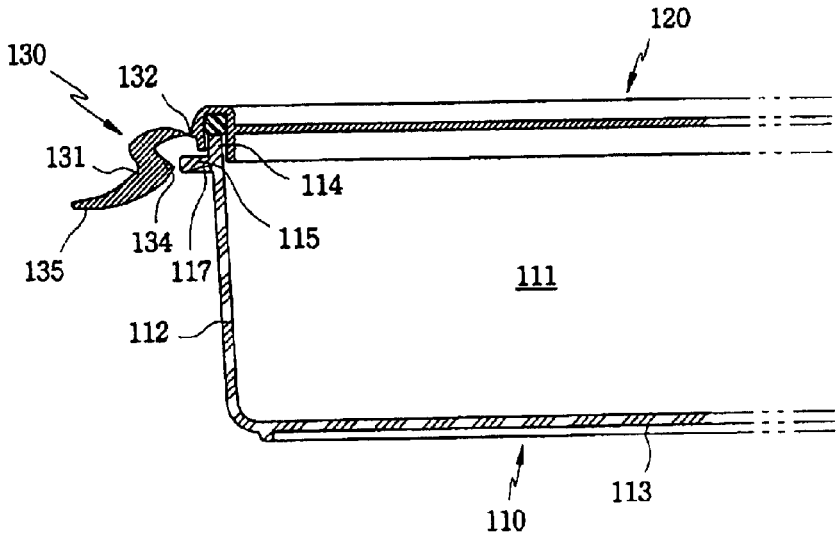
FIG. 9 is a cross-sectional view taken along the line IX—IX of FIG. 8.
Figure 10:
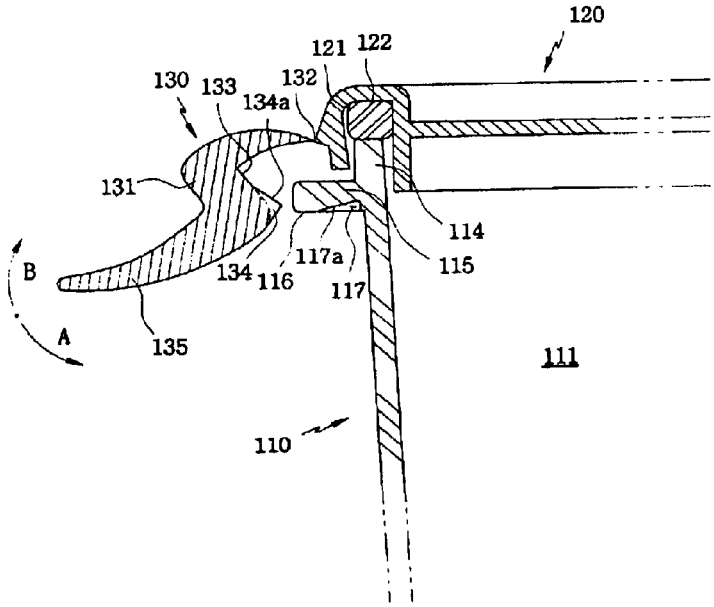
FIG. 10 is a partial enlarged cross-sectional view for the 'X' part of FIG. 9.

To this end, as can be readily seen from FIGS. 8 through 10, engaging grooves 117 of a predetermined length are defined on lower surfaces 116 and at middle portions, facing the respective locking wings 130, of the flange portions 115. In this preferred embodiment of the present invention, the engaging grooves 117 are defined to extend in a lengthwise direction of the lower surfaces 116 of the flange portions 115. The engaging groove 117 of the flange portion 115 is formed with a first inclined surface 117*a* which is inclined upward from an outside toward an inside of the flange portion 115, so that an engaging protuberance 134 of the locking wing 130 can be firmly locked to the first inclined surface 117*a*.

The locking wings 130 are formed at middle portions of four sides of the rectangular lid 120 so that they can be locked on the flange portions 115 of the rectangular case 110. Each locking wing 130 has an elastic engaging part 131 which covers the lower surface 116 of the flange portion 115 when locking the rectangular lid 120 to the rectangular case 110, an engaging protuberance 134 which is engaged in the engaging groove 117 of the flange portion 115 while elastically deforming the elastic engaging part 131, and an extended part 135 which is curved to allow the locking wing 130 to be pressed and raised by the user's hand.

While each locking wing 130 is pivoted downward about a boundary region 132 (in the direction shown by the arrow 'A' in FIG. 10) to lock the rectangular lid 120 to the rectangular case 110, the elastic engaging part 131 is flexed to cover the lower surface 116 of the flange portion 115. At a completely pivoted position, an upper surface 133 of the elastic engaging part 131 confronts the lower surface 116 of the flange portion 115.

The engaging protuberance 134 is formed on the upper surface 133 of the elastic engaging part 131 to project in a horizontal direction and elastically engaged into the engaging groove 117. To this end, the upper surface 133 of the elastic engaging part 131 is formed to have the same contour as the engaging groove 117. In other words, an upper surface of the engaging protuberance 134 comprises a second inclined surface 134*a* which is inclined in an opposite direction to the first inclined surface 117*a* of the engaging groove 117 so that the second inclined surface 134*a* is engaged with the first inclined surface 117*a* while the locking wing 130 is in the locked state.

Hereafter, locking operations using the locking wings 130 of the food item receiving container according to the present invention and effects thereof will be described.

First, after a food item to be stored is received in a receiving space 111 of the rectangular case 110, the rectangular lid 120 is placed on the opened upper end of the rectangular case 110. Namely, the rectangular lid 120 is placed on the rectangular case 110 so that the sealing projections 114 of the rectangular case 110 are inserted into the sealing grooves 121 of the rectangular lid 120, in which the silicon packing 122 is accommodated.

Figure 11:
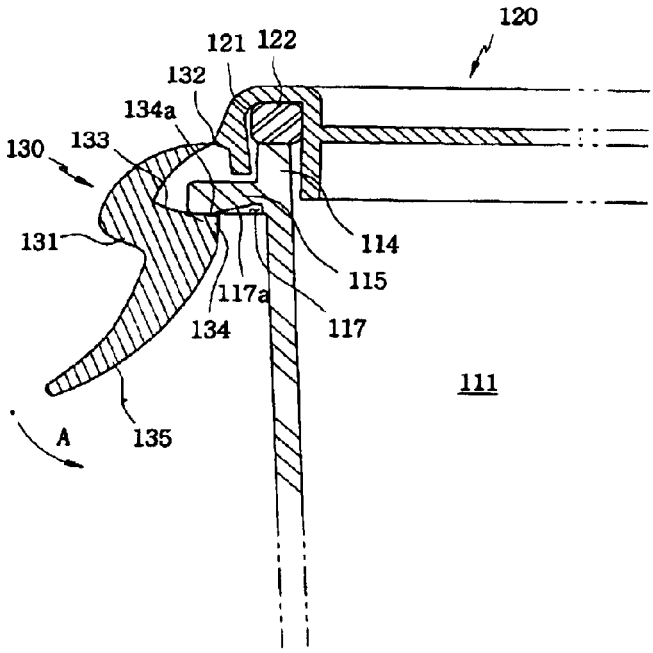
FIGS. 11 and 12 are partial cross-sectional views sequentially illustrating a locking procedure of a locking wing according to the second embodiment of the present invention.
Figure 12:
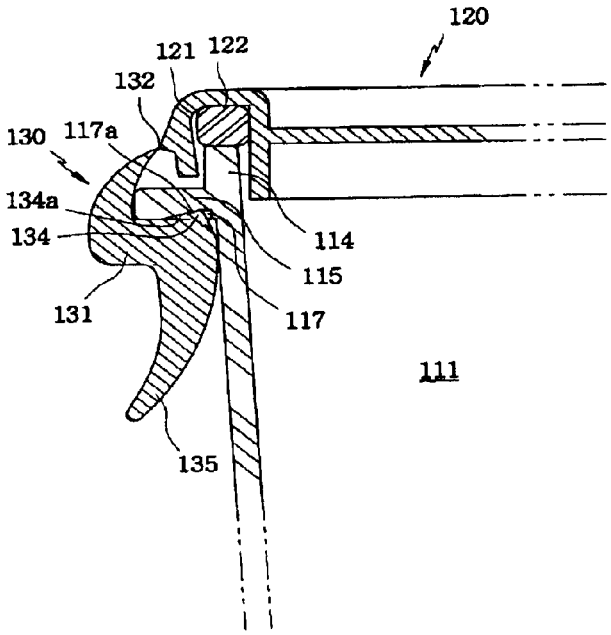

In this state, as shown in FIGS. 11 and 12, if the extended part 135 of each locking wing 130 is pressed downward, the locking wing 130 is pivoted about the boundary region 132 of the rectangular lid 120 in the direction shown by the arrow 'A'. Consequently, as the elastic engaging part 131 is elastically deformed, the elastic engaging part 131 covers the lower surface 116 of the flange portion 115, and the elongate engaging protuberance 134 is respectively engaged into the elongate engaging groove 117 of the flange portion 115. At this time, as the second inclined surface 134*a* of the engaging protuberance 134 is brought into surface contact with the first inclined surface 117*a* of the engaging groove 117, they are firmly locked to each other. Hence, the rectangular lid 120 is not unlocked from the rectangular case 110 unless an intended opening force is applied.

Meanwhile, if the extended part 135 of each locking wing 130 is grasped and raised, as the elastic engaging part 131 of the locking wing 130 is elastically deformed, the elongate engaging protuberance 134 is disengaged from the elongate engaging groove 117. Therefore, as the locked state of the locking wing 130 is released, it is possible to easily remove the rectangular lid 120 to open the rectangular case 110.

At this time, since the locking structures of the rectangular case 110, for locking the locking wings 130, are not exposed to the outside, an aesthetic outer appearance of the receiving container is not deteriorated, and it is possible to wash the rectangular case 110 in an easy manner.

In the meanwhile, while the above embodiments were explained with respect to the food item receiving container having the rectangular case, a person skilled in the art will readily recognize that the present invention can of course be applied to a food item receiving container having a cylindrical case.

As apparent from the above description, in the food item receiving container according to the present invention, engaging grooves of a predetermined length are defined on a lower surface and at a middle portion, facing a corresponding locking wing, of a flange portion which is formed on each side wall of a case. Each locking wing has an elastic engaging part formed with engaging protuberances which are engaged into the engaging grooves while being elastically deformed. Therefore, in the present invention, since a locking structure is formed not to project to the outside through the locking wings, an aesthetic appearance of the entire food item receiving container is not deteriorated. Also, because the case can be easily washed, user convenience is increased. Moreover, due to the fact that the possibility of a foreign substance to be captured in the locking wings is eliminated, a sanitary issue is not raised.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A food item receiving container, comprising:

a case opened at an upper end thereof to define a receiving space therein;

a lid for closing the opened upper end of the case;

a plurality of locking wings integrally formed at edges of the lid, respectively, so that they can be pivoted upward and downward; and flange portions projectedly formed in the shape of a band on upper end outer surfaces of side walls of the case, respectively, so that the locking wings can be engaged with the flange portions to be maintained in a locked state;

wherein at least one engaging groove is defined on a lower surface and at a middle portion, facing a corresponding locking wing, of each flange portion, and wherein each locking wing has an elastic engaging part which is formed to be flexed and thereby cover the lower surface of the flange portion when the corresponding locking wing is pivoted downward, and engaging protuberances which are horizontally formed on an upper surface of the elastic engaging part to be engaged with the engaging groove of the flange portion while elastically deforming the elastic engaging part.

2. The container as set forth in claim 1, wherein two elongate engaging grooves are parallel defined on the lower surface of the flange portion; and two elongate engaging protuberances are formed on the upper surface of the elastic engaging part of the locking wing to be engaged into the two elongate engaging grooves, respectively.

3. The container as set forth in claim 1, wherein the engaging groove of the flange portion is formed with a first inclined surface which is inclined upward from an outside toward an inside of the flange portion; and the upper surface of the elastic engaging part of the locking wing comprises a second inclined surface which is inclined in an opposite direction to the first inclined surface of the engaging groove so that the second inclined surface is engaged with the first inclined surface while the locking wing is in the locked state.

* * * * *